US006155353A

United States Patent [19]

Ottestad

[11] Patent Number: 6,155,353

[45] Date of Patent: Dec. 5, 2000

[54] IMPACT TOOL

[76] Inventor: Jack B. Ottestad, P.O. Box 527, Geona, Nev. 89411

[21] Appl. No.: 09/359,973

[22] Filed: Jul. 23, 1999

[51] Int. Cl.[7] ..... B25D 9/14

[52] U.S. Cl. ..... 173/128; 91/229; 91/276; 173/204; 173/208

[58] Field of Search ..... 173/128, 91, 206–208, 173/201, 202, 204, DIG. 4; 91/276, 321, 165, 224, 229; 92/134

[56] References Cited

U.S. PATENT DOCUMENTS

| | | | |
|---|---|---|---|
| 3,267,677 | 8/1966 | Bollar | 173/128 |
| 3,687,008 | 8/1972 | Densmore | 91/165 |
| 3,739,863 | 6/1973 | Wohlwend | 173/204 |
| 3,822,633 | 7/1974 | Ottestad | 91/224 |
| 3,866,690 | 2/1975 | Lance et al. | 173/204 |
| 4,111,269 | 9/1978 | Ottestad | 173/207 |
| 4,264,107 | 4/1981 | Janach et al. | 91/276 |
| 4,295,411 | 10/1981 | Grantmyre et al. | 91/165 |
| 4,745,981 | 5/1988 | Buske | 173/202 |
| 5,065,824 | 11/1991 | Ottestad | 173/206 |
| 5,269,382 | 12/1993 | Ottestad | 173/128 |

*Primary Examiner*—Peter Vo
*Assistant Examiner*—Jim Calve
*Attorney, Agent, or Firm*—Donald D. Mon

[57] ABSTRACT

A percussive hammer for delivering impacts driven by oil which is quickly applied under pressure derived from a system supply and from a source of compressed gas.

10 Claims, 11 Drawing Sheets

IMPACT TOOL

FIELD OF THE INVENTION

A percussive hammer for delivering impacts driven by oil which is quickly applied under pressure derived from a system supply and from compressed gas.

BACKGROUND OF THE INVENTION

Percussive hammers which deliver sharp impacts, usually for pavement breaking, ditch digging, spading and breaking of obsolete structures are well-known. They are characterized by Ottestad patent No. 4,111,269. This field has undergone extensive product development in the last few decades, and the functional product in many embodiments has been made and sold by a large number of well-established and able companies.

The common aim of these companies has been to develop a hammer which can deliver a stronger blow with least energy cost, longer product life between repairs and overhauls, reduction of the severity of circumstances that lead to early failure, lightness of product weight for the blows to be delivered, economy of manufacture, and ease of assembly and disassembly.

The concept of all of these devices is elegantly simple. A striking tool supported in the body is hit by an internal rapidly moving hammer to drive the tool (usually pointed, spade-shaped or a bucket), against a target toward which the tool is pointed or is pressed against. The energy is delivered in a very short burst, so as to produce an impact with a steep and sharp peak.

To drive the hammer, a volume of high pressure gas is compressed by a piston to a still higher pressure. The piston is driven by a charge of hydraulic fluid under pressure. For convenience this will hereafter be called "oil". The hammer is isolated from driving fluid pressure during the charge operation, and is biased toward its returned position. When the device is triggered, the face of the hammer is quickly exposed to oil that is pressurized both by the force of the piston driven by the gas and the supply line pressure, which together drive the hammer to strike the tool.

The elegant simplicity of this concept belies the problems involved in designing and manufacturing an economical, effective, and long-lived device. The very rapid fluid flows, the need to stop the hammer without harming the device when the tool is fired "into the air", and especially the complexity of the parts (and their expense) required by previous designs testify to the difficulty of the task.

It is an object of this invention to provide an impact tool, substantially all of whose parts can principally be made by straightforward and economical turning, milling and broaching processes. In so doing, the number of pieces has been substantially reduced. For example, tie rods are completely eliminated.

BACKGROUND OF THE INVENTION

An impact tool according to this invention includes a body having an internal passage with a longitudinal axis along which the parts of the tool move. It is the axis along which the blows are delivered.

A striking tool is reciprocably mounted in a bearing surface in the passage. A pin and slot arrangement allows the tool a suitable range of axial movement without falling out. The striking tool has a face to be hit by a hammer, thereby to drive the striking tool. This is the objective of the impact tool.

The hammer is axially slidably and sealingly fitted in the passage. It has a striking face to impact a face of the striking tool, and a driver face, which faces in the axial direction away from the striking tool.

A sleeve is fitted and fixed in the passage. An enlarged portion of the hammer slides in a central passage in the sleeve. A reduced portion of the hammer slides in a reduced portion of the body passage. The sleeve carries valving surfaces directed toward the drive face of the hammer, and other faces directed oppositely toward a reciprocable valve.

A reciprocable annular piston is slidably fitted into the passage. The passage is closed by an end cap so that the piston partially bounds a gas chamber on one of its faces and an oil chamber on its other face.

A tubular valve is reciprocably fitted in an aperture through the piston. Both the piston and the valve are thereby axially movable relative to the body and to each other.

A pressure port admits oil under pressure to the oil chamber. A drain port enables, when open, the release of oil from the oil chamber through the tubular valve.

The valve has valving surfaces which engage the valve-facing surfaces on the sleeve, and also valving surfaces which cooperate with the end cap.

The valve and piston include position-limiting means which establish important relative positions. The driving face of the hammer carries valving surfaces to maintain the hammer in its retracted condition until fired.

These features are provided in a construction requiring only a minimum number of readily manufactured parts which can be assembled in a way to require minimal effort to assemble the impact tool.

The above and other features of this invention will be fully understood from the following detailed description and the accompanying drawings, in which:

DETAILED DESCRIPTION OF THE INVENTION

Figure 1A:
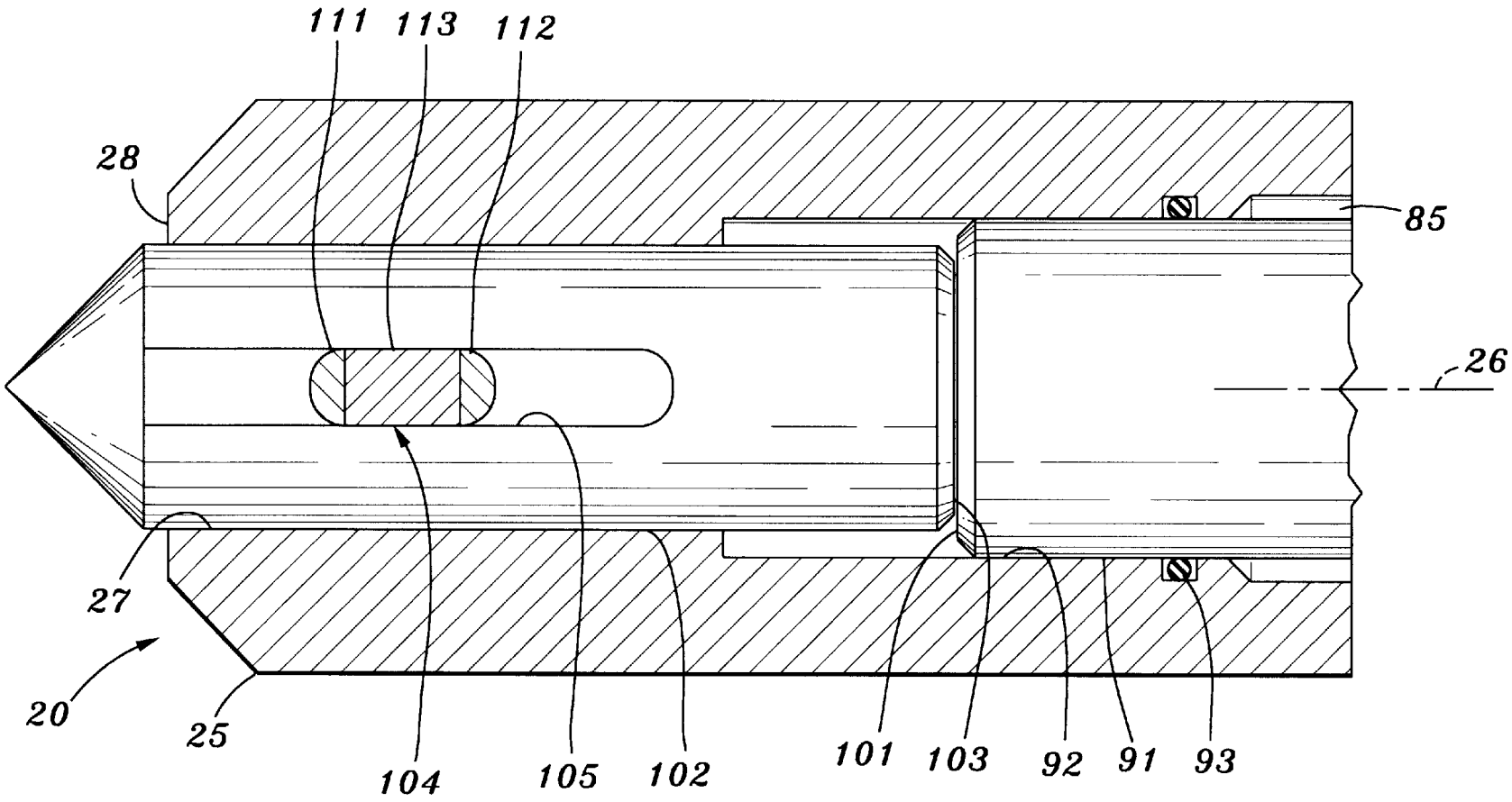
FIG. 1 is an axial cross-section of the presently-preferred embodiment of the invention, the illustrated portions being circular in lateral cross-section, showing the tool components in an arbitrary arrangement, the right hand edge of FIG. 1*a* directly matching the lefthand edge of FIG. 1B.
Figure 1B:
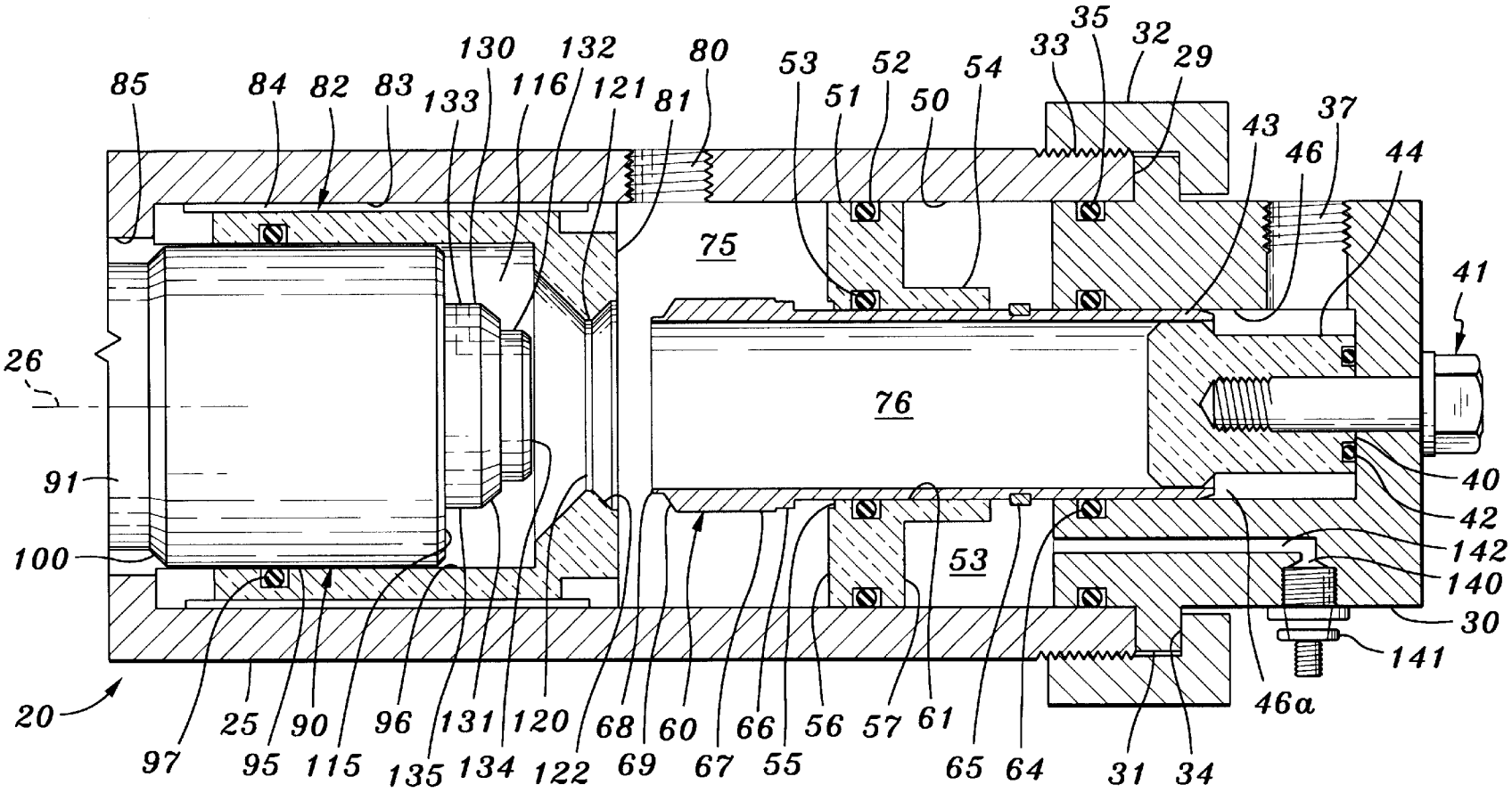

The presently-preferred impact tool 20 of this invention is shown in FIGS. 1*a* and 1*b*, which should be read together. Its parts in these figures are shown in arbitrary locations for purposes of illustration. The tool as shown is not under pressure or in any particular operating or repose condition. The parts are spaced apart in this drawing to facilitate showing of their structure.

Body 25 has a longitudinal axis 26, which is the axis of its operation and delivery of its blows. A longitudinal passage 27 extends from end to end of the body. It has various diameters for purposes to be explained. It has an open striker end 28 and a capped end 29 (FIG. 1*b*).

An end cap 30 has a peripheral shoulder 31 which bears against end 29 of the body. An end cap nut 32 is threaded to the body by threads 33. It has a shoulder 34 which bears against shoulder 31 of the end cap. A seal 35 seals between the body and the end cap.

A drain port 37 passes through the side of the end cap, the end cap being cup-shaped. A drain plug 40 is held to the inside of the end cap. A bolt 41 holds it in place. A seal 42 is placed between the end plug and the inner wall of the end cap. The end plug includes a peripheral cylindrical drain valve surface 43, and a recessed peripheral surface 44 that forms a channel to drain port 37.

The end cap also carries a drain valve surface 46 opposite to drain valve surface 43. These are axially fixed relative to one another with a drain valve gap 46*a* between them.

Adjacent to the end cap and extending away from closed end 29, the passage has a piston bore 50, which is cylindrical and suitably smooth. A piston 51 is slidably fitted in the piston bore with a piston body carrying seals 52,53 and an axially extending cylindrical skirt 54. A peripheral notch 55 is formed in face 56 of the piston for a reason to be disclosed. Face 57 of the piston faces into a gas chamber 58.

A tubular valve 60 is freely slidably in passage 61 in the piston. Seal 53 seals between them. This forms the closure of gas chamber 58, whose volume varies as a function of the axial location of the piston. The outer wall of the valve makes a sliding fit with drain valve surface 46 in the end cap. A seal 64 seals between them. This completes the closure of gas chamber 58.

A piston stop 65 formed as a ring seated in a groove in the outer wall of the valve member limits the travel of the piston into the gas chamber by being struck by the skirt of the piston.

Figure 6:
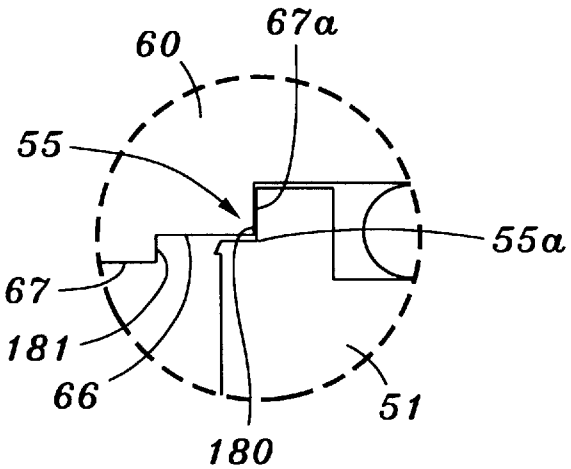
FIG. 6 is a fragmentary cross-section of portion 6—6 in FIG. 4.

Steps 66 and 67 on the outer wall of the valve are aligned with notch 55 on face 56 of the piston for purposes to be disclosed when FIG. 6 is discussed.

A valving lip 68 extends axially from the left hand end of the valve in FIG. 1B. An orifice valving surface 69 is formed adjacent to it, as will be described later in fuller detail in FIG. 5.

At its other end, it will be observed that the valve in the illustrated position can close the drain valve gap 46*a* between the end plug and the end cap. In that condition it will prevent flow between through gap 46*a*, drain passage 45, and drain port 37.

Pressure port 80 through the wall of the body enters oil pressure chamber 75. This chamber extends through the central passage 76 in the valve, around the valve as far as face 56 of the piston, and, when the valve is closed, to face 81 of a valve sleeve 82.

Valve sleeve 82 is fixed in an enlarged portion 83 of the body passage. It does not reciprocate. A group of spline-like axial grooves 84 extends from end to end of sleeve 82. In turn these communicate with a peripheral deceleration groove 85 in the wall of the body passage for a purpose to be disclosed.

A hammer 90 having a reduced-diameter hammer head 91 (FIG. 1*b*) is slidably fitted in a hammer bore 92 in the wall of the body passage, with a sliding seal 93 between them. The hammer has an enlarged portion 95 which is slidingly fitted in a hammer bore 96 in valve sleeve 82. A seal 97 is placed between them.

A return shoulder 100 between portions 91 and 95 of the hammer faces into bore 85. The outer diameter of portion 95 is somewhat smaller than the diameter of bore 85, which allows for flow from the bore 85 into grooves 84 for deceleration and hammer return purposes yet to be described.

Hammer 90 has a striking face 101 facing striking tool 102. Striking tool 102 has a face 103 to receive blows from face 102. It is reciprocable in the body with limits of axial motion established by a cross-pin 104 that is fixed in the body, and the length of an axial slot 105 which passes through the striking tool.

While the cross-pin may have any suitable cross-section shape, it takes considerable abuse in use, and such pins are often very difficult to remove, and are also troublesome to install.

Figure 11:
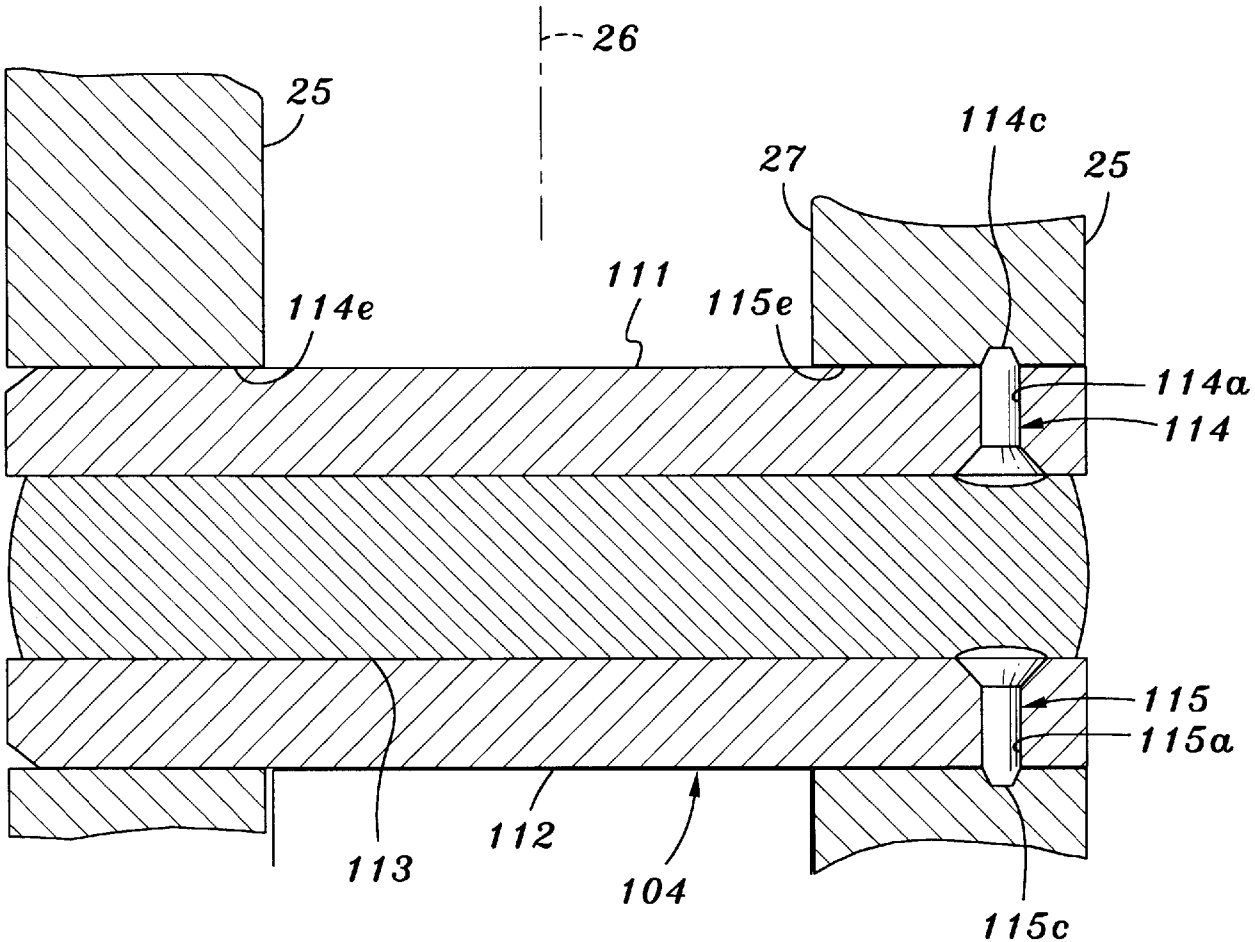
FIG. 11 is a cross-section of an optimum cross-pin for use in this invention. shown installed in the tool.

The cross-pin illustrated in FIG. 11 has considerable advantages. It comprises two parts 111,112. These parts are somewhat larger than semi-circular, both having the same diameter, and a height greater than their radius. They are separated and joined together by a layer 113 of a stiff rubber or rubber-like material, such as tire tread material. The pins are glued to this layer by a suitable metal to rubber adhesive. Two headed counter sink type pins 114,115 have their rounded heads glued to the rubber and their shanks passed through holes 114*a*, 115*a* in parts 111 and 112. Their shanks have rounded ends 114*b* and 115*b* for camming purposes. The ends of the shanks in repose project above the surface of the parts. If the shanks are pressed hard enough they can be moved inwardly enough to enable the pins to enter holes in the body and be received in recesses 114*c*, 115*c*. This will keep them in the recesses, and the cross-pin will be retained. A sharp blow will release them because their rounded-end shanks can be cammed out of the recesses, which also can be slanted in section. The rubber can be deformed to permit the amount of axial movement of the pins that is required. This entire structure can be squeezed into complementarily-shaped ports 114*e*. 115*e* in the wall of the body, and will be strongly retained by the expansive force of the rubber-like material. If preferred, a conventional circular pin may be used instead, without the intervening layer of rubber but this will rarely be preferred. The rubber portion significantly reduces the noise compared to a solid metal pin.

It will be observed that the striking tool is freely slidable within limits established by the cross-pin and slot. It is struck by the hammer. Its location in the passageway will be determined by the position and orientation of the impact tool relative to its target. If the operator is pressing the tool against the target it will be pushed into the passageway. If it is not in contact with anything, it can be out as far as it can go. Then the hammer must be decelerated to avoid self-destruction of the impact tool because of its over travel past the motion returned position of the striking tool. This feature will be fully discussed below.

Reverting now to valving sleeve 82, and specifically to its function, it will be seen that it faces both valve 60 and face 115 of the hammer. Its function is appropriately to provide for isolation of a drive chamber 116 from oil pressure chamber 75, and to enable flow between them at other times.

For these purposes an orifice 120 is formed in the end of cup-like sleeve 82. It has an orifice valving surface 121, complementary to lip 68 and, extending from it toward valve 60, a tapered valving surface 122, as more particularly shown in FIG. 5.

A valving head 130 is carried by portion 95 of the hammer. It includes two tapered surfaces 131,132 that are stepped apart. A vent passage 133 passages extends from face 134 to sidewall 135 for a purpose to be described and disclosed below.

A gas charge port 140 with a shut-off charge valve 141 gives access through a charge line 142 to gas chamber 58. A charge of a suitable gas such as nitrogen compressed to a desired pressure is injected into the gas chamber, and then the charge valve is closed until replacement gas is needed. This completes the general description of the parts. The operation of the tool will now be described, together with some further discussion of structure shapes.

Figure 2:
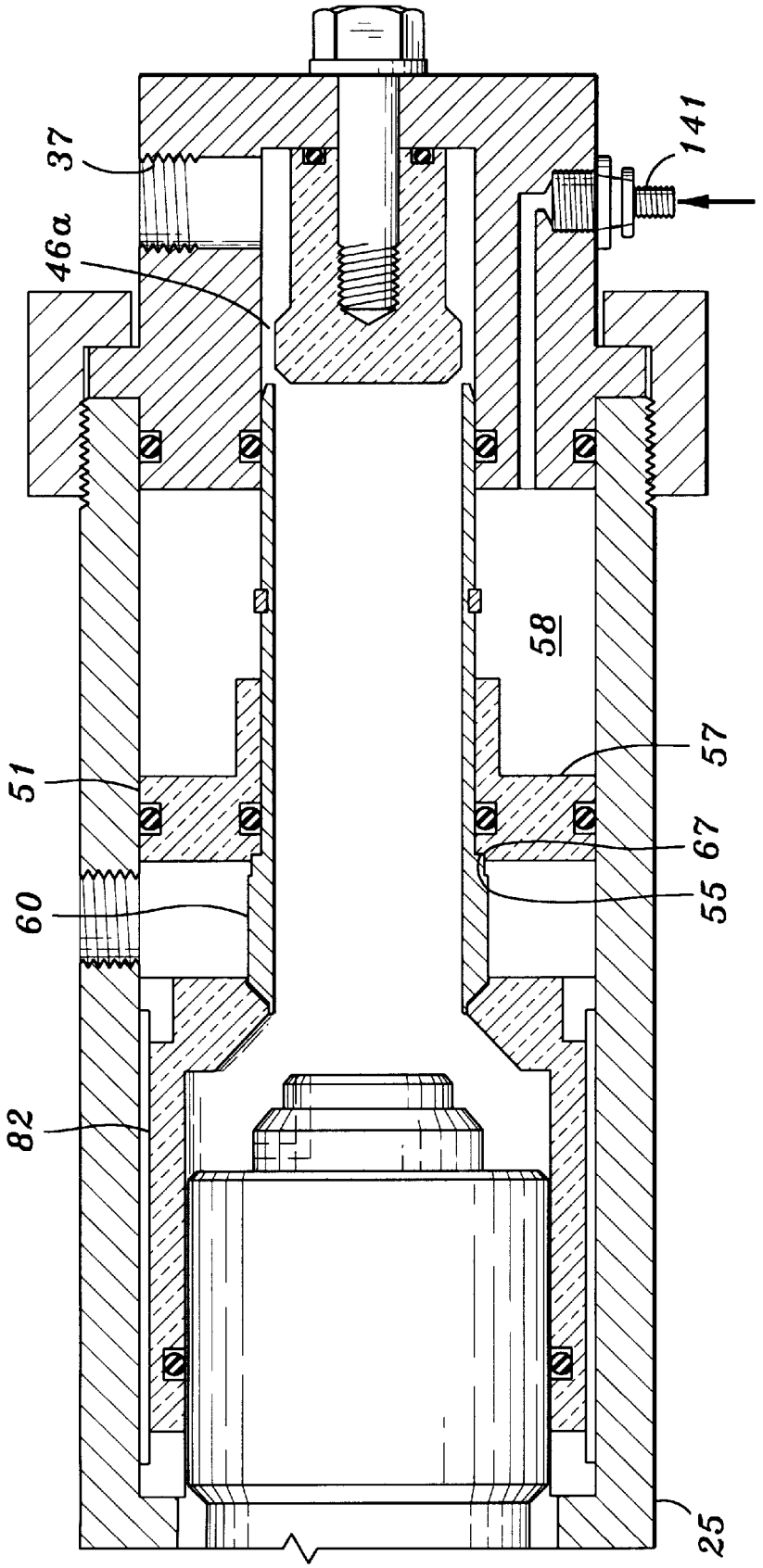
FIGS. 2–4 are similar but partial axial cross-sections showing some elements in progressive orientations.

FIG. 2, which for convenience in illustration does not show the striking tool and much of the hammer, shows the impact tool being charged with gas. For this purpose, gas charge valve 141 has been opened and a charge of gas has been introduced. This will drive the piston to the left as illustrated. As will be described in more detail later, a surface of notch 55 engages a surface of step 67 on valve 60 (see FIG. 6). The force on face 57 of the piston drives the valve against sleeve 82 as shown.

The gas pressure is permitted to stabilize in the gas chamber, which is at its maximum volume at this time, and gas charge valve 141 is closed. The pressure at this condition is less than the available hydraulic line pressure, for example a gas pressure of 1,500 psi in its expanded condition, which when compressed will rise to about 1,800 psi. This will still be less than available oil line pressure, which will usually be about 2,000 psi.

This closes valve 60 at the valve sleeve 82 and leaves drain valve gap 46*a* open past the drain plug as shown. As yet, no oil pressure has been exerted. The impact tool is simply charged with gas and ready for use. This awaits the application of oil pressure. Until then the location of the hammer and of the striking tool are arbitrary.

Figure 3:
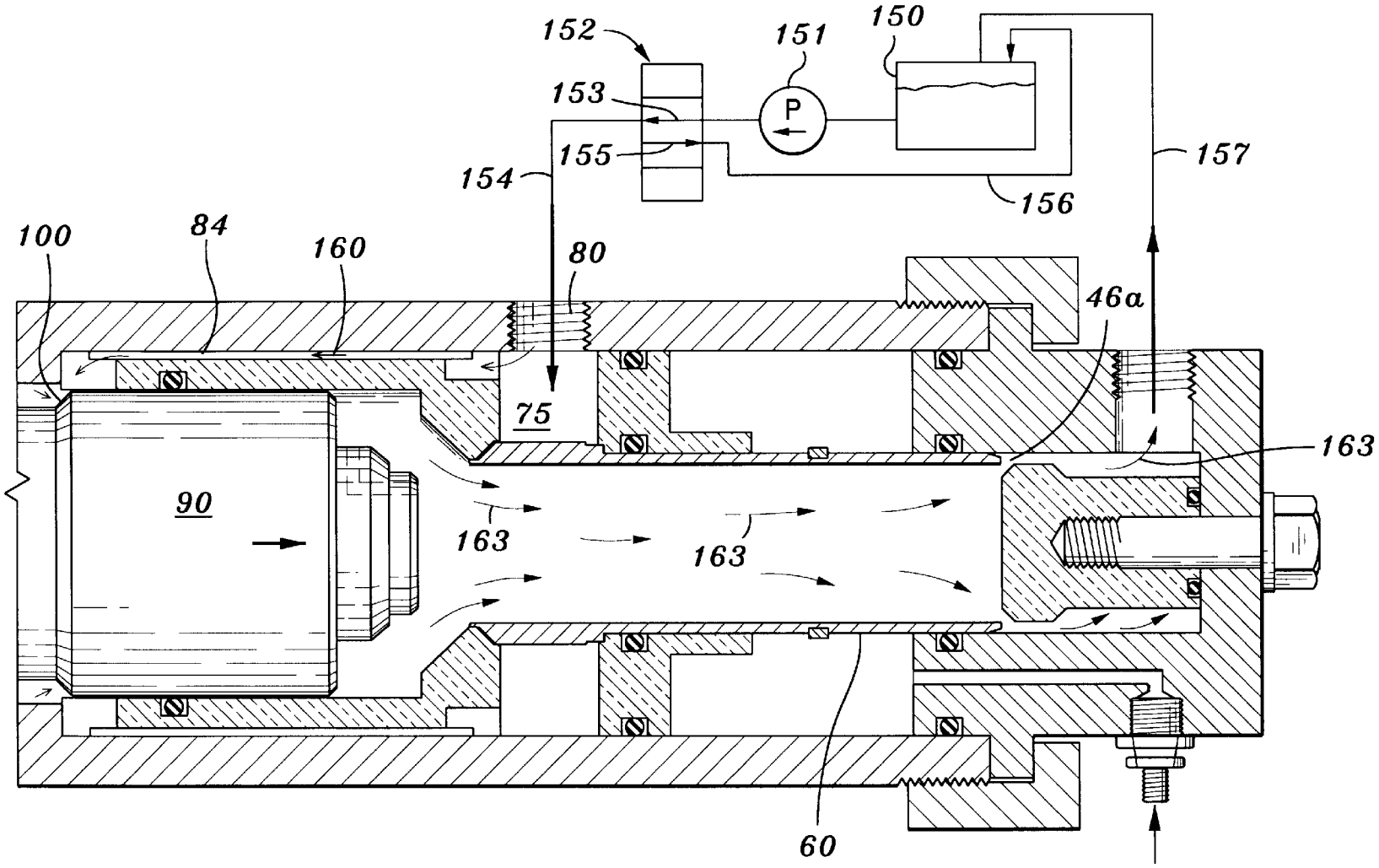

FIG. 3 illustrates the start of the firing sequence. To operate this impact tool, oil from a source 150 such as a reservoir of oil is passed through a pump 151 and a selector valve 152. The selector valve has two settings. Setting 153 supplies fluid under pressure to pressure port 80 through line 154. Setting 155 returns oil to the reservoir through line 156. The pump can continue to run and need not be turned off between blows, so that valve 152 acts as an operating control for the tool. By-passed fluid returns to the reservoir through drain line 156. Drain fluid from the tool returns to the reservoir through line 157.

With valve 60 closed at orifice 120, oil under pressure enters pressure chamber 75. Its flow is shown by arrows 160, through channels 84 to apply pressure on return shoulder 100 on the hammer. This forces the hammer away from the striking tool, and drives any oil in pressure chamber 75 ahead of it, through the drain valve 46*a* between valve 60 and drain plug 40. It will freely flow to the reservoir as shown by arrows 163. In this condition the hammer is driven away from the striker tool. The striker tool remains wherever the operator arranges it.

Figure 4:
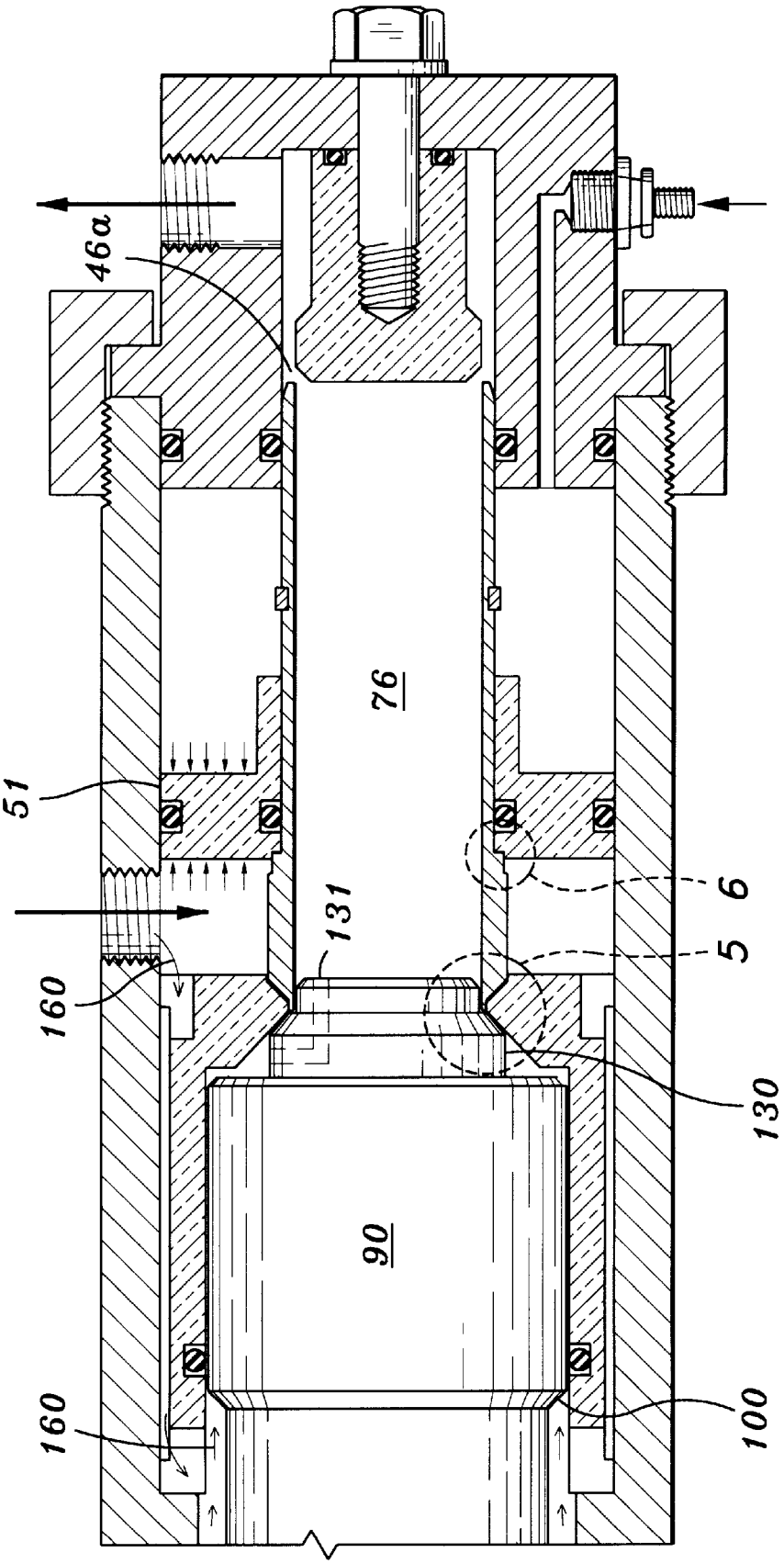

FIG. 4 shows the next operating step in which oil under pressure has continued to flow into pressure chamber 75. As shown by arrows 160, hammer 90 has been pressed strongly against sleeve 82 to form a seal with it. Valve 60 is still closed at this end, and gap 46*a* is open to drain, as is the tubular passage 76 in the valve. However, the hammer has closed orifice 120.

Figure 5:
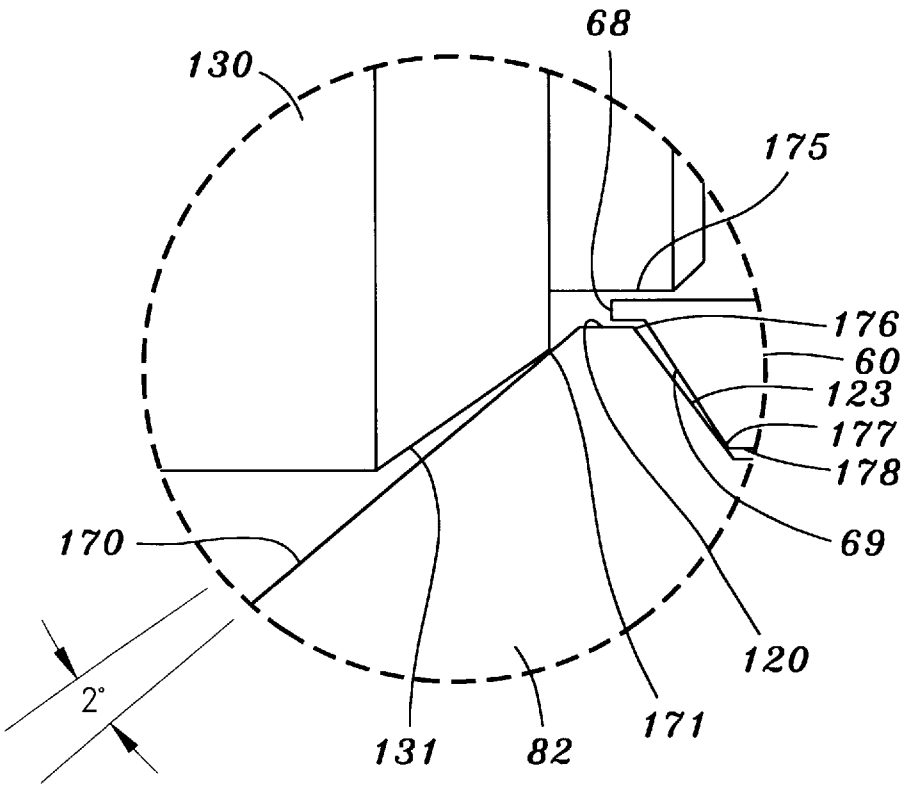
FIG. 5 is a fragmentary cross-section of portion 5—5 in FIG. 4.

FIG. 5 (which, like FIG. 6 is not section lined to facilitate its understanding) shows a frusto-conical seal 170 on sleeve 82. It faces toward seal 131 on the hammer, which also is frusto-conical. The half-angle of seal 131 is about 2 degrees smaller than the half angle of seal 170. Thus, a line seal 171 is made between the two. This will prevent a face-to-face lock between these two surfaces, and will facilitate their quick separation.

Further attention is called to another relationship to the spool 130 on the hammer. The lip 68 on valve 60 has entered orifice 120 with a small gap (clearance) 175,176 on both sides. In addition, sealing face 123 on the sleeve and 69 on valve 60 have different conical half angles, differing by about 2 degrees so that a line seal 177 is made between them. There is also a gap 178 between surfaces on the sleeve and on the valve. Thus, gaps 176 and 178 act as cushions to avoid potentially damaging hard contact between the valve and the sleeve.

Attention is also called to FIG. 6, further illustrating relationships between steps 67 and 68*a* on valve 60, and notch 55 on the piston. When shoulder 67*a* approaches face 55*a* of the notch, liquid between them will be metered out through a gap 180. This will avert too hard a blow between the piston and the valve when they abut one another.

Further, a prevailing bias force biasing the valve toward the sleeve 82 will be exerted on face 181 of step 68. This holds the valve closed and the drain valve open.

The foregoing should make it evident that when oil pressure is sufficiently exerted, the valve will be biased toward the sleeve, and the hammer will be biased toward the orifice. The orifice is now closed from both sides.

Continuing introduction of oil will move the piston into the gas chamber to compress the gas in it. The stored energy in the gas chamber is a function of the initial pressure of the gas on the piston, plus the small incremental increase caused by the change of volume. This is limited by how far the piston can move.

Figure 7:
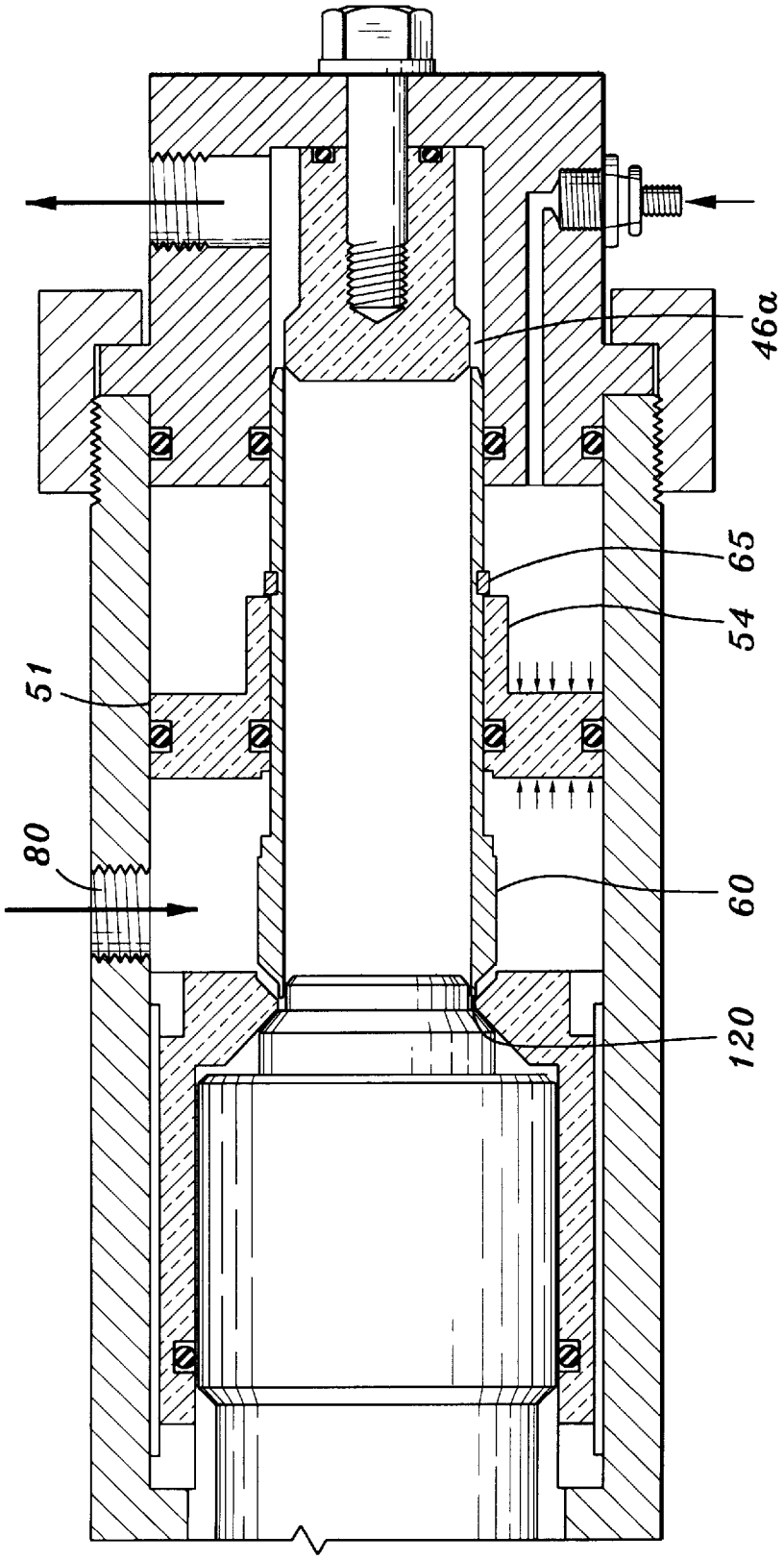
FIGS. 7–10 are axial cross-sections showing the elements in further progressive orientations.

Ultimately it is intended that the end of piston skirt 54 will strike limit ring 65. As shown in FIG. 7, the net force on the piston can move the valve off of the sleeve, thereby opening orifice 120. This movement of the valve will close the drain gap 46*a* between the drain plug and the end cap and close the drain.

Figure 8:
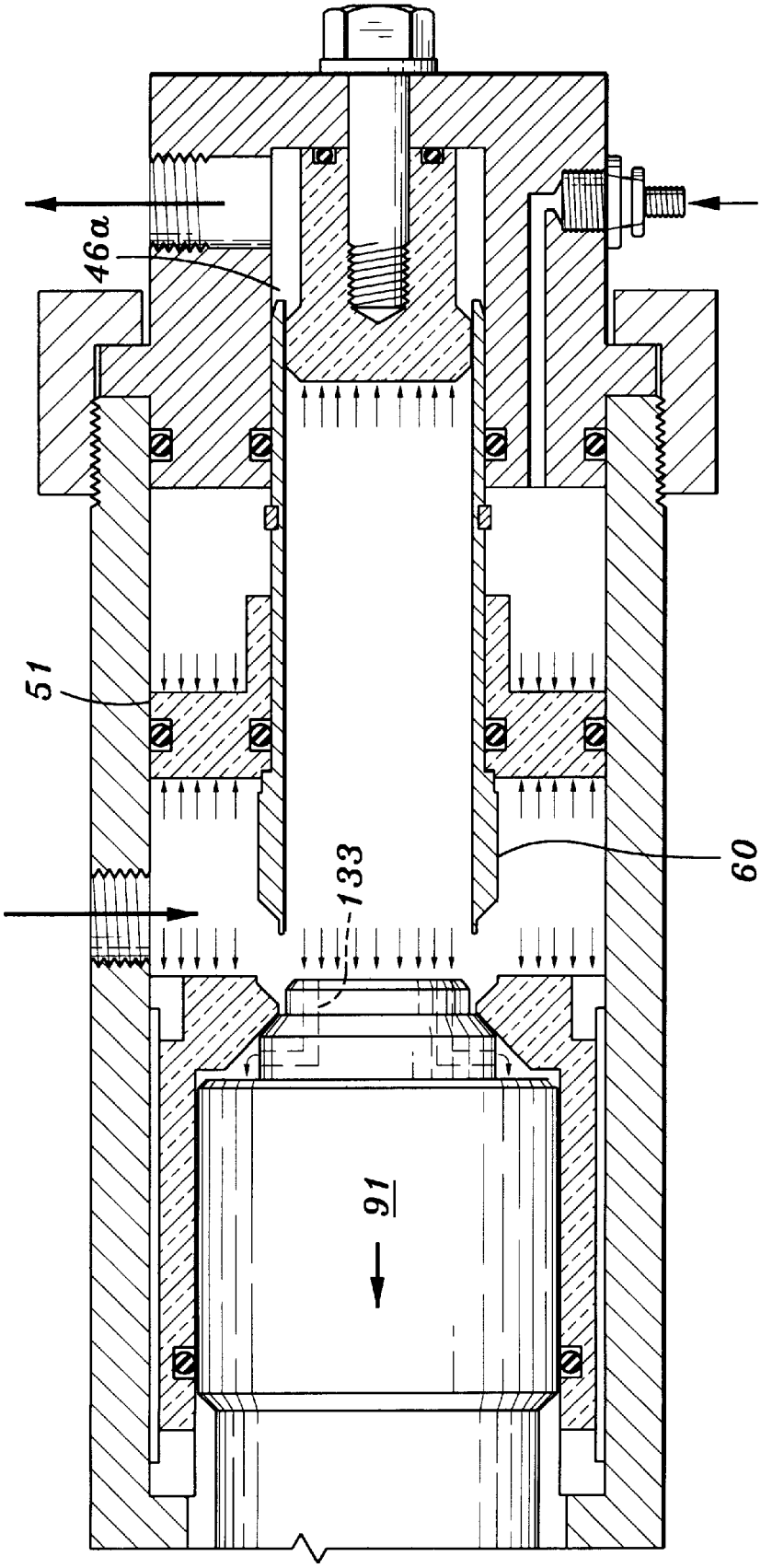

High pressure oil will now rush through the orifice, and will drive the valve full open as shown in FIG. 8. The hammer head now sees full oil pressure across its entire face, directly on the central portion, and through by-pass passage 133. The applied oil pressure comes both from this incoming supply and from the displacement of the piston.

Figure 9:
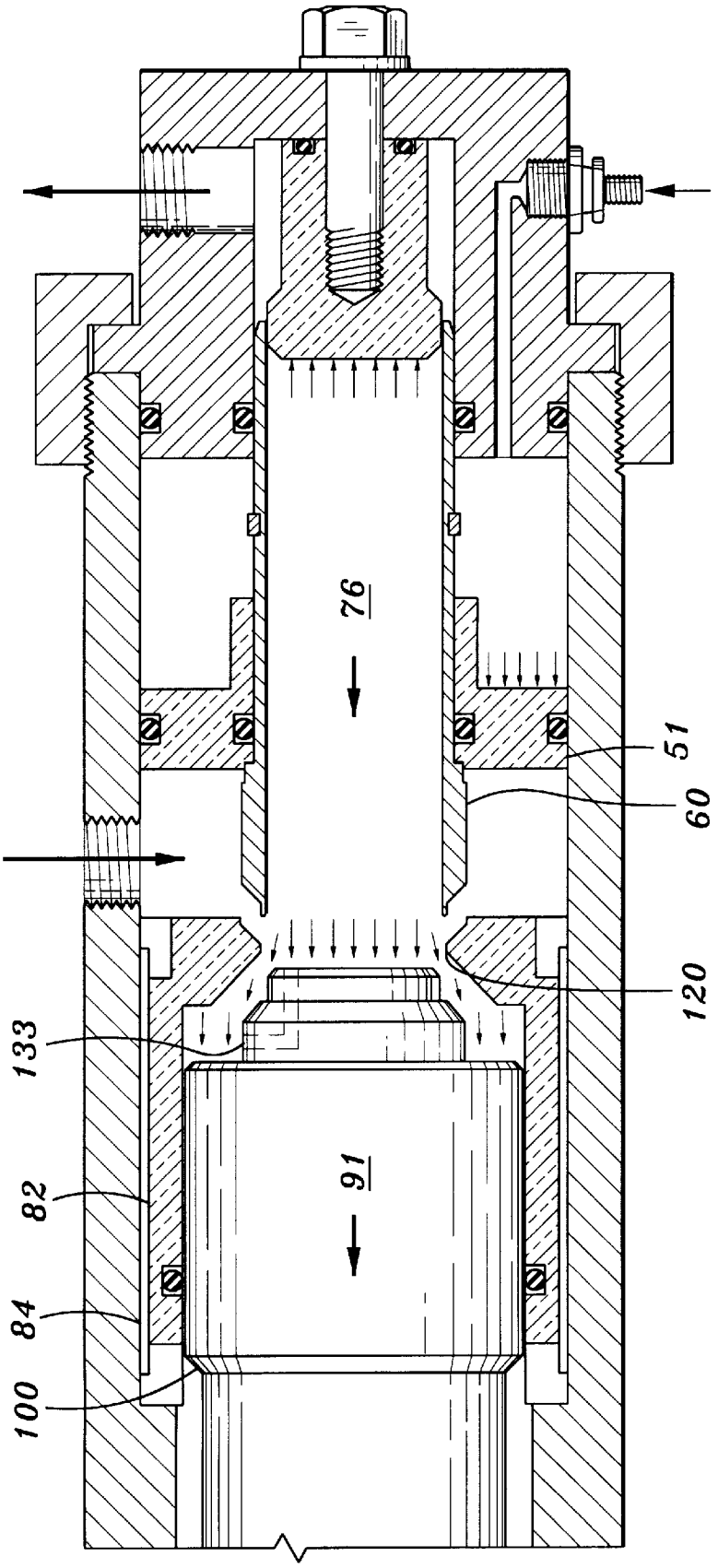

As shown in FIG. 9, the hammer is being driven by the oil, and the valve is being driven by the piston toward the orifice. This driving stroke will continue until valve 60 again closes orifice 120 and opens drain valve gap 46*a*. Gap 46*a* remains closed until the closure of the sleeve to enable the driving to continue. It will open when the valve closes orifice 120 to enable the piston to return. This is the driving stroke, intended to send the hammer flying to strike the striking tool. This is the anticipated blow which is the ultimate objective of the tool.

Figure 10:
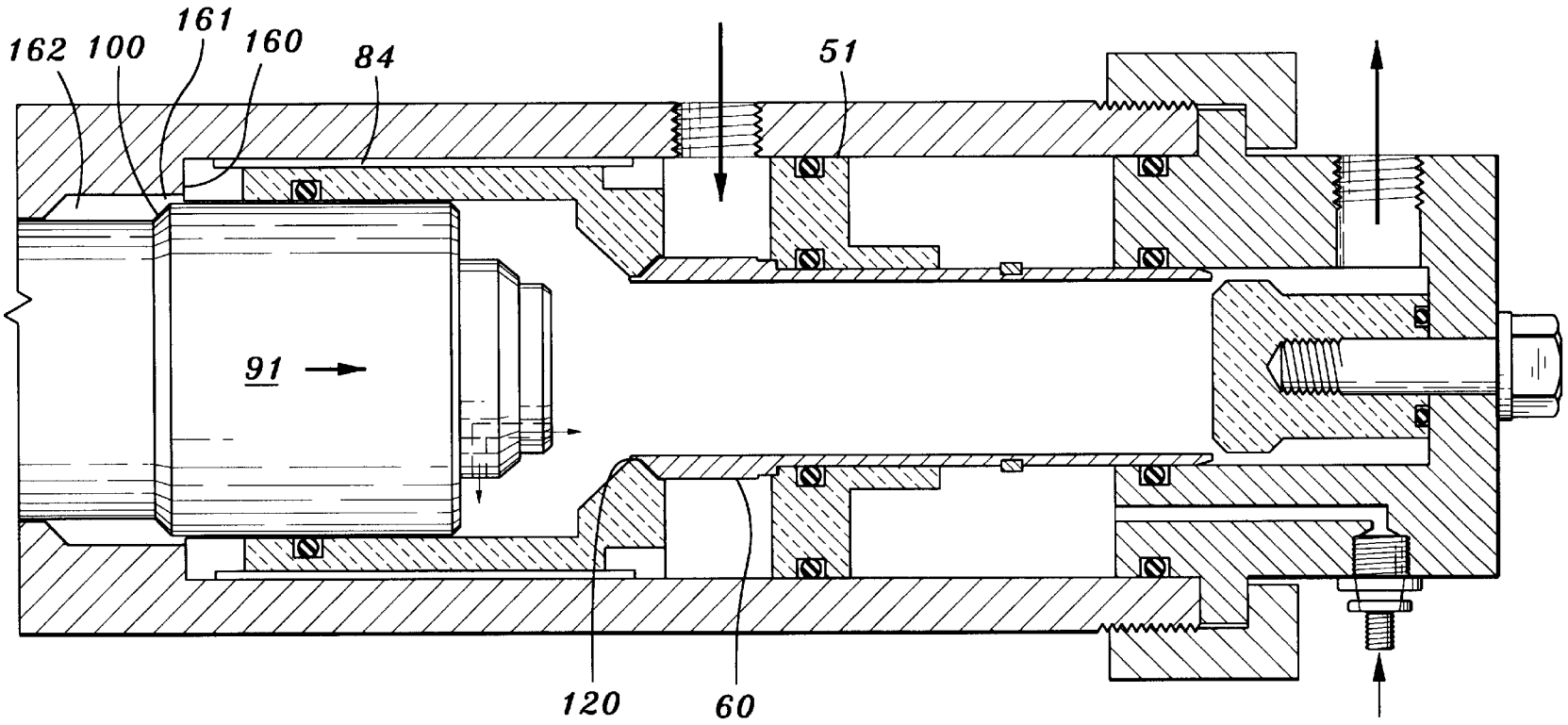
Figure 12:
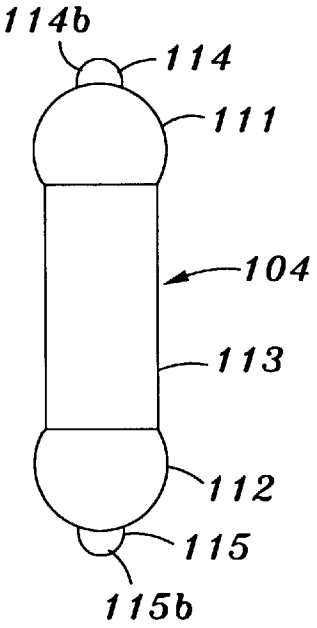
FIG. 12 is a sideview of the uncompressed cross-pin of FIG. 11

FIG. 10 shows the condition at the intended end of the driving stroke. Valve 60 is closed on the orifice; the hammer has struck the striking tool. The return shoulder 100 on the hammer has passed edge 160, leaving a gap 161 between the hammer and the inside wall of deceleration chamber 162. Further travel of the hammer is resisted by the need to displace fluid through this gap on opposition to oil pressure from the continuing supply. When shoulder 100 passes edge 160 it is fully exposed to pressure oil through channel 84. This continues as a bias force on the hammer to return it.

Therefore if the hammer did not strike the striking tool at its most retracted position, the tool will be decelerated by all of these forces. The deceleration travel is from 4 to 8 times that of the driving stroke so that potentially damaging overtravel is avoided.

Now the procedure will be repeated so long as oil pressure is supplied to the tool. It can be continuous (cycled) by holding the control valve in its open setting. It will stop when the valve setting is changed. It can be fired simply by briefly opening the control valve.

The reader will observe the elegant simplicity of this design, and of the small number of parts, and especially the absence of tie rods. The use of tie rods to hold a percussive tool together leads to complications of extra weight, stretching and bending, and difficulty in assembly and repair.

The tool of this invention uses only conveniently-manufactured circularly-sectioned parts, readily made by turning, broaching, and milling operations. The assembly is held together only by a threaded cap. It is circularly sectioned.

Assembly of this tool can be completed in only a few minutes, as can its disassembly for repair, with the use of simple tools. Conventional tools generally take hours for this procedure and require very strong and special tooling for the task.

The illustrated impact tool, which is circularly sectioned, utilizes a hammer whose larger diameter is about 6 inches. Other dimensions can be scaled from it on the drawings. The materials of construction are conventional, generally a high grade steel for the impacting parts. If desired the hammer can be made in two parts, its valving surfaces made of lighter and more compliant material. The seals can be any suitable type. An oil supply pressure of about 2,000 psi and a gas pressure of about 1,500 psi when the piston is extended are appropriate. With this tool, a blow of approximately 500 foot pounds can be delivered by a hammer traveling about ½ inch.

This improved impact hammer has a number of unique features which contribute to its longevity, convenience of use, and energy economy. Some of these are as follows:

1. The driving pressure from the gas chamber matches the incoming oil supply pressure, so there is no amplification of gas pressure, as required by many prior art devices.
2. During the power stroke, pressure oil continues to feed the tool. The oil supply remains constant, thereby substantially eliminating pressure cycling.
3. The blow energy can be selected and regulated by changing the gas pressure in the gas chamber.
4. When near the end of its power stroke, the fluid driving force is shut off from the hammer so that acceleration of the hammer stops just before the impact on the striking too. This eliminates "kick-off".
5. This tool can operate against a higher drain pressure. Hydraulic systems in this field are not vented. Instead their drain (reservoir) pressures are on the hundreds of pounds per square inch. This tool is insensitive to such high back pressures.
6. There is no drop-off of incoming oil pressure during the charging stroke when the piston is forced toward the gas chamber. Thus there is less hose pulsing—the tendency of hoses to kick around when pressures are pulsed.
7. Cavitation is greatly reduced by the fact that hydraulic pressure remains nearly constant. Cavitation tends to occur when there are rapid flows through gaps and orifices under substantial pressure differentials.
8. If the hammer does not strike the impact tool, there is a reduction of energy as the head is decelerated and returned. This can save considerable energy, because it returns oil to move the piston.

This invention is not to be limited by the embodiments shown in the drawings and described in the description, which are given by way of example and not of limitation, but only in accordance with the scope of the appended claims.

What is claimed is:

1. An impact tool comprising:

a body having a longitudinal axis, a central longitudinal passage, a striking end and a closed end;

a striking tool reciprocably mounted in said passage;

a hammer reciprocably mounted in said passage so disposed and arranged as to strike the striking tool in one direction of movement, said hammer having a lesser diameter nearer the striking tool and a larger diameter, there being a return shoulder joining them;

a valving sleeve fixed in said passage, a portion of said hammer being reciprocably and sealing fitted in said valving sleeve, said sleeve including an orifice and an adjacent seal facing said hammer, and a seal facing away from said hammer, an axial channel extending along the outside of the sleeve from end to end;

a seal on said hammer facing said adjacent seal on the valving sleeve;

an axially reciprocable tubular valve having an outer wall spaced from the wall of the body;

a piston slidably and sealingly fitted between the wall of the body and the outer wall of the piston, said piston including a skirt slidable on said valve;

a stop on said outer wall of said valve disposed and arranged to be engaged by the said skirt;

a lip and an adjacent seal on an end of said valve, said lip proportioned to enter said orifice leaving a gap around it, a pair of steps on the outer wall of said valve facing said piston and a notch in said piston facing one of said steps;

an end cap closing said passage at its other end, said end cap together with said valve and piston forming a gas chamber to hold a charge of gas under elevated pressure;

a drain plug fixed to said end cap extending into said passageway having an outer wall, and said end cap having an inner wall, said last-named walls forming a drain channel between them, said valve having a portion which enters said drain passage in some positions;

a drain port through said end cap on the opposite side of the drain channel from the valve;

a pressure port to admit oil under elevated pressure into an oil chamber on the opposite side of the sleeve from the hammer, the face of the piston away from the gas chamber facing into the oil chamber;

whereas, gas under elevated pressure is charged into said gas chamber, pressing said valve against the sleeve to close the orifice, oil under pressure is admitted to the oil chamber to force the hammer against the surface on the sleeve, also to close the orifice;

the piston is moved by oil pressure so the piston skirt strikes the stop on the valve and the valve is moved away from the orifice, thereby exposing the hammer to oil pressure, and driving the hammer toward the striking tool, while closing the drain channel, thereafter the piston returning the valve to the orifice, opening the drain channel and enabling the hammer to be returned and engage the sleeve seal.

2. An impact tool according to claim 1 in which said passage includes a deceleration groove always in communication with said return shoulder.

3. An impact tool according to claim 1 in which said hammer has an end face facing toward the orifice, and a vent passage extending from said end face to a location on the side of said hammer on the other side of the seal on said hammer.

4. An impact tool according to claim 3 in which said seal on the valving sleeve facing the hammer, and the seal on the hammer facing the orifice are frusto-conical, with a different half conical angle from one another.

5. An impact tool according to claim 1 in which said adjacent seal on the end of said valve and said adjacent seal on said valving sleeve facing away from said hammer are frusto-conical, with different half conical angles from one another.

6. An impact tool according to claim 5 in which said seal on the valving sleeve facing the hammer, and the seal on the hammer facing the orifice are frusto-conical, with a different half conical angle from one another.

7. An impact tool according to claim 1 in which the closure formed by the valve and valve sleeve is alternative to the closure formed by the valve at the drain channel.

8. An impact tool according to claim 1 in which said drain port discharges to a closed reservoir, and in which a continuously operating pump withdraws oil from'said reservoir and delivers it to said pressure port under constant pressure, and in which a selector valve downstream from said pump passes said oil to said oil port or alternatively to the reservoir.

9. An impact tool according to claim 1 in which said body includes a central passage with a peripheral wall, a cross-passage through said wall and the striking tool in said passage includes a cross-slot, and in which a cross-pin extends through said cross-passage and cross-slot, said cross pin comprising:

metal parts each having a dimension of length, a curved outer longitudinal surface and a flat surface, and a rubber-like layer having a pair of opposite surfaces to which said flat surfaces are adhered, and in which the cross-pin has a dimension of height when uncompressed and can be compressed to a lesser height to enter the cross-passage.

10. An impact tool according to claim 9 in which each said metal part has a hole therethrough, and in which a pin with a head and a shank with a rounded end is placed with its shank in a said hole with its head against the layer and its shank projecting beyond its metal part, whereby the shank is retractable into the hole sufficiently to enable the pin to be cammed into the metal part to enable the insertion of the cross-pin, and thereafter extend into an internal recess in the impact tool.

* * * * *